United States Patent [19]

Matsubara et al.

[11] Patent Number: 4,795,689

[45] Date of Patent: Jan. 3, 1989

[54] ELECTROSTATIC IMAGE DEVELOPING TONER FOR USE IN HEAT-ROLLER FIXING

[75] Inventors: Akitoshi Matsubara; Satoru Ikeuchi; Kunio Akimoto; Yoshio Takizawa, all of Hachioji, Japan

[73] Assignee: Konishiroku Photo Industry Co. Ltd., Tokyo, Japan

[21] Appl. No.: 88,053

[22] Filed: Aug. 21, 1987

[30] Foreign Application Priority Data

Aug. 30, 1986 [JP] Japan ..... 61-202730

[51] Int. Cl.[4] ..... G03G 9/08; G03G 13/20

[52] U.S. Cl. ..... 430/99; 430/109; 430/110; 524/904; 525/934

[58] Field of Search ..... 430/99, 109, 110; 524/904; 525/934

[56] References Cited

U.S. PATENT DOCUMENTS

| | | | |
|---|---|---|---|
| 3,965,021 | 6/1976 | Clemens et al. | 430/129 |
| 3,967,962 | 7/1976 | O'Malley | 430/107 X |
| 4,385,107 | 3/1983 | Tanaka et al. | 430/109 X |
| 4,457,998 | 7/1984 | Grumber et al. | 430/110 X |
| 4,528,257 | 7/1985 | Polderman et al. | 430/109 |

FOREIGN PATENT DOCUMENTS

| | | | |
|---|---|---|---|
| 56-65146 | 6/1981 | Japan | 430/109 |
| 57-32447 | 2/1982 | Japan | 430/109 |
| 60-90344 | 5/1985 | Japan | 430/109 |
| 62-62368 | 3/1987 | Japan | 430/109 |
| 62-63940 | 3/1987 | Japan | 430/109 |

*Primary Examiner*—Roland E. Martin
*Attorney, Agent, or Firm*—Jordan B. Bierman

[57] ABSTRACT

An electrostatic image developing toner useful for the formation of a toner image by electrophotographic process which employs a heat-fixing method by the use of a heat roller under pressure, wherein said toner comprises as the essential constituents a nonlinear polymer, a low-melting polymer which has a melting point of from 50° to 130° C. and which is incompatible with said nonlinear polymer, a copolymer composed of a segment polymer which is at least compatible with the above nonlinear polymer and a segment polymer which is at least compatible with said low-melting polymer and a coloring agent.

24 Claims, No Drawings

ELECTROSTATIC IMAGE DEVELOPING TONER FOR USE IN HEAT-ROLLER FIXING

FIELD OF THE INVENTION

The present invention relates to an electrostatic image developing toner for use in developing electrostatic latent images formed in the electrophotographic process, electrostatic printing process, electrostatic recording process, and the like, and more particularly to an electrostatic image developing toner for use in heat-roller fixing.

BACKGROUND OF THE INVENTION

For example, there are various methods conventionally known as the electrophotographic process (reference can be made to U.S. Pat. No. 2,297,691, and the like).

Generally speaking, an electrostatic image carrier comprised of a photoconductive photoreceptor is charged and imagewise exposed to thereby form an electrostatic latent image thereon, the electrostatic latent image is then developed by either a two-component-type developer comprised of a toner and carrier or a one-component-type developer comprised of a magnetic material-containing toner alone, and the developed toner image is transferred onto a support such as a sheet of copying paper and fixed thermally or under pressure, whereby a visible image is formed.

As for the toner fixing method, various methods have been used to date. Above all, the heat-roller fixing method is most useful. The heat roller fixing method is one in which a support, such as a sheet of paper, carrying a toner image is transported being in contact with a heated roller to thereby fix the toner image to the support. This method is advantageous in respect of safety and also in the energy saving because it reduces the loss of heat.

However, where the heat-roller fixing method is used, at the time of the heat roller fixing, the toner in the molten condition is to come into contact with the surface of the heat roller, but, in any of conventional toners, its adhesiveness in its molten condition is so high that part of the molten toner is transferred and sticks onto the surface of the heat roller, resulfing in a trouble, the so-called offset phenomenon, that the toner on the heat roller is then retransferred onto and stains the subsequenty copying paper.

Further, in recent years, the development of a toner capable of being fixed at a much lower temperature than ever before is strongly desired to meet the demand for the realization of high-speed copying apparatus or the miniaturization of copying apparatus. That is, in a high-speed copying apparatus, when copying is performed in successsion to make a large number of copies, the heat of the heat roller is absorbed by sheets of copying paper, so that the resupply of heat cannot overtake the necessary amount of heat therefor, and as a result the heat roller's temperature becomes lowered, tending to cause a fixing trouble. In a small-size copying apparatus, the apparatus needs to be of an energy-saving and compact type by reducing the capacity of the heater of the heat roller thereof, but if the capacity of the heater is reduced, it takes time to heat up the heat roller, so that a lengthy warming-up time is required or the resupply of heat cannot overtake the necessary amount of heat for running copying operations, resulting in the lowering of the heat roller's temperature to tend to cause a fixing trouble.

Accordingly, in order to solve these problems, a toner which is capable of being fixed at a temperature lower than that heretofore in use and excellent in the antioffset property is required.

A conventional technique of accomplishing fixation at a low temperature by using a binder for a toner a crystalline polymer having a melting point of 50° to 150° C. and an activation energy of not more than 35 kcal/mole for its fluidization is disclosed in, e.g, Japanese Patent Examined Publication No. 36586/1982. However, where this toner is used in the heat-roller fixing method to form an image, there occurs a problem that the toner is inadequate in the antioffset property. Therefore, in order to prevent the occurrence of the offset phenomenon, copying apparatus needs a means to supply an oil for providing mold releasability to the surface of its heat roller, but it leads to the problem that the apparatus becomes complex. In addition, the crystalline polymer is so soft that the toner and the carrier are hardly mixed uniformly, and as a result the triboelectrification property of the toner becomes unstable, leading to the problem that the resulting toner image is not clear. Further, the crystalline polymer constituting the toner is liberated to be transferred and sticks onto the carrier grains or to the photoreceptor's surface; i.e., the so-called 'toner filming' phenomenon occurs, thus leading to the problem that it adversely affects the image formation. Furthermore, the use of the crystalline polymer deteriorates the durability of the resulting toner.

As is described in, e.g., Japanese Patent Examined Publication No. 23354/1976, the use of a resin of a cross-linked structure is known as a technique to improve the antioffset property. However, if an attempt is made to obtain an adequate antioffset property by increasing the cross-linking degree of the resin, then the fixing temperature increases to deteriorate the fixability at a low temperature, whereas if the cross-linking degree is lowered in order to obtain an adequate fixability at a low temperature, no adequate antioffset property can be obtained; after all, in the resin of the cross-linked structure it is difficult to satisfy both the antioffset property and the fixability at a low temperature. Providing the apparatus with a means to supply an oil for giving mold releasability to the surface of the heat-fixing roller is known as a technique to prevent the occurrence of the offset phenomenon, but this technique is disadvantageous in respect that the oil supply mechanism-provided copying apparatus is complex, and the oil is heated to be evaporated to give out a stench to mar the environmental sanitation. It is therefore desirable that the toner in itself, without the aid of an external means, have a high offset-producing temperature and a low minimum fixation temperature, thus having adequate antioffset property and fixability at a low temperature.

Owing to such circumstances, we have been continuing our investigation of techniques for obtaining adequate antioffset property and fixabiity at a low temperature of the toner by using a resin formed by mixing a resin of the cross-linked structure with a low-melting resin.

It has now been found, however, that there is an additional problem in such techniques; i.e., in such techniques, uniformly mixing the resin of the cross-linked structure with the low-melting resin is essential in order to obtain an adequate antioffset property and fixability at a low temperature, but it is difficult to mix such resins uniformly, and consequently the difficulty brings about various problems:

Firstly, due to the not-uniform mixing of both resins, the low-melting resin tends to be liberated, so that in the toner the softeness characteristic of the low-melting resin appears largely, bringing about toner's agglomeration inside the developing device; the so-called blocking phenomenon, and the toner-carrier triboelectrification tends to become inadequate, and the fluidity of the resulting developer is lowered, thus bringing about the problem that, eventually, the obtained copy is of a fogged, unclear image.

Secondly, in repeatedly making copies of an image, a phenomenon that the liberated low-melting resin is transferred onto and sticks to carrier grains and the phtotreceptor's surface; the so-called toner filming phenomenon, occurs at an early stage, and the consequently obtained image shows a low image density with much fog, and thus is an obscure image. Thirdly, due to the not-uniform mixing of both resins, it is difficult to disperse a coloring agent uniformly into a mixture of them, thus resulting in a copy image being deteriorated in the color tone.

Thus, it is the status quo that there has still not been obtained any satisfactory toner for use in heat-roller fixing, which has adequate fixability at a low temperature and antioffset property, excellent antiblocking and triboelectrification properties, and excellent color tone, and which is capable of forming a fogless, clear image, and also capable of repeatedly forming excellent copies of an image.

SUMMARY OF THE INVENTION

It is an object of the present invention to provide an electrostatic image developing toner for use in heat-roller fixing which satisfies all the following requirements: the toner shall (1) have adequate fixability at a low temperature, (2) have an adequate antioffset property, (3) have an excellent antiblocking property, (4) have an excellent triboelectrification property, (5) enable to obtain an excellent color-tone image, (6) enable to obtain a fogless, clear image, and (7) enable to obtain a number of repeated excellent copies of an image.

The present invention specifically relates to an electrostatic image developing toner for use in heat-roller fixing which comprises the following Constituents (A), (B), (C) and (D) as the essential Constituents thereof:

Constituent (A): A nonlinear polymer,

Constituent (B): A low-melting polymer which is incompatible with Constituent (A) and whose melting point is from 50° to 130° C., Constituent (C): A copolymer formed by the chemical combination of a segment polymer which is at least compatible with the above Constituent (A) and a segment polymer which is at least compatible with the above Constituent (B), Constituent (D): A coloring agent.

DETAILED DESCRIPTION OF THE INVENTION

Since the above polymer as Constituent (A) and the polymer as Constituent (B) are incompatible with each other, it is difficult to obtain a uniformly mixed toner from these polymers alone. The toner of this invention, however, comprises also a copolymer as Constituent (C) comprised of two segment polymers that are compatible with Constituent (A) polymer and Constituent (B) polymer, so that in this toner the copolymer as Constituent (C) is coordinated at the boundary between Constituent (A) polymer and Constituent (B) polymer to play, so to speak, a surfactant-like role, and consequently the Constituent (B) polymer comes to be uniformly micorscopically dispersed and mixed into the Constituent (A) polymer. As a result of the respective polymers being uniformly dispersed and mixed, the dispersiblity of a coloring agent into them also is improved.

Accordingly, this toner displays both the excellent property based on the nonlinear polymer as Constituent (A) and the excellent property based on the low-melting polymer as Constituent (B); namely, the polymer as Constituent (A) is linear and hard and plays chiefly a role of increasing the triboelectrification property and durability of the toner, and at the same time a role of increasing the antioffset property by having the toner show a high viscoelasticity to have a high mold releasability even when heated to be molten by the heat roller. The polymer as Constituent (B) has a melting point of from 50° to 130° C. and plays chiefly a role of increasing the fixability at a low temperature of the toner, but this Constituent (B) polymer, since it is soft, tends to lower the toner's antiblocking property or antioffset property, or deteriorate the toner's triboelectrification property to lower the durability. The toner of this invention, however, further comprises a copolymer as Constituent (C) comprised of two segment polymers which are compatible with both the polymer as Constitutent (A) and the polymer as Constituent (B), so that the respective segment polymers are partially dissolved into the polymer as Constituent (A) and the polymer as Constituent (B), respectively, and therefore the copolymer as Constituent (C) is coordinated at the boundary between the Constituent (A) polymer and the Constituent (B) polymer to play, so to speak, a surfactant-like role. Consequently, the Constituent (B) polymer comes to be microscopically uniformly dispersed and mixed into the Constituent (A) polymer.

As a result, a toner having adequate fixability at a low temperature and antioffset property and excellent in the triboelectrification property as well as in the antiblocking property can be obtained, whereby a fogless, clear image can be stable formed. Also, displaying such excellent properties stably, the toner can form stably repeatedly excellent copies of an image. And, being satisfactory in the mixed condition of the respective polymers as well as in the dispersibility of a coloring agent thereinto, the toner can form an excellent color tone-having image.

The present invention will be illustrated in detail.

The above Constituent (A) is a non linear polymer. The linear polymer is desirable to be one that is capable of strongly retaining the low-melting polymer as Constituent (B) in the toner and of providing the toner with a high mold releasability. From this point of view, the linear polymer had better have a glass transition point Tg of preferably from 40° to 80° C., more preferably from 50° to 80° C., and most preferably from 55° to 70° C. If the glass transition point Tg is extremely low, the antiblocking property can be lowered, while if it is extremely high, the fixability at a low temperature can be lowered.

The glass transition point Tg herein, when measurement is carried out at a temperature-increasing speed of 10° C./min by using a differential scanning calorimeter 'Low-Temperature DSC' (manufactured by Rigaku Denki K.K.), is a temperature at an intersecting point of the extension of the base line below the glass transition point and the tangential line indicating the maximum inclination of the curve formed from the start of the peak up to the top of the peak.

The nonlinear polymer is desirable to be of a weight average molecular weight Mw of not less than 50,000. If the weight average molecular weight Mw is extremely small, the antioffset property can be lowered.

The nonlinear polymer content of the toner is preferably from 50 to 99% by weight, and more preferably from 55 to 95% by weight. When the content is extremely small, the antioffset property can be lowered, while then the content is extremely large, the fixability at a low temperature can be lowered.

As for such the nonlinear polymer, and amorphous polymer may be suitable used. Usable examples of the amorphous polymer include those formed by nonlinearizing vinyl-type polymers, polyesters, epoxy resins, polyamides, polyurethanes, phenol resins, and the like, by using a cross-linking agent. Of these polymers, the nonlinearized vinyl-type polymers and the nonlinearized polyesters are particularly suitable.

The nonlinear vinyl polymer can be obtained by the polymerization reaction of a vinyl group-having monomer with a polymerizable bifunctional or polyfunctional vinyl group having monomer for nonlinearization. Examples of the vinyl group-having monomer include sytrenes such as, e.g., styrene, o-methylstyrene, p-methylstyrene, p-ethylstyrene, α-methylstyrene, 2,4-dimethylstyrene, p-tert-butylstyrene, p-n-octylstyrene, p-n-dodecylstyrene, p-methoxystyrene, p-phenylstyrene, p-chlorostyrene, 3,4-dichlorostyrene, etc., and derivatives of these styrenes; vinyl esters such as vinyl acetate, vinyl propionate, vinyl benzoate, vinyl butyrate, etc.; vinyl chloride; α-methylene aliphatic monocarboxylic acid esters such as methyl acrylate, ethyl acrylate, n-butyl acrylate, isobutyl acrylate, tert-butyl acrylate, propyl acrylate, n-octyl acrylate, dodecyl acrylate, 2-ethylhexyl acrylate, stearyl acrylate, 2-chloroethyl acrylate, phenyl acrylate, methyl α-chloroacrylate, dimethylaminoethyl acrylate, diethylaminoethyl acrylate, methyl methacrylate, ethyl methacrylate, propyl methacrylate, n-butyl methacrylate, isobutyl methacrylate, tert-butyl methacrylate, n-octyl methacrylate, dodecyl methacylate, 2-ethylhexyl methacrylate, stearyl methacrylate, phenyl methacrylate, etc.; acrylic acids or methacrylic acid derivatives such as acrylonitrile, methacrylonitrile, acrylamide, etc.; vinyl ethers such as vinyl-methyl ether, vinyl-ethyl ether, vinyl-isobutyl ether, etc.; vinyl ketones such as vinyl-methyl ketone, vinyl-hexyl ketone, vinyl-isopropenyl ketone, etc.; N-vinyl compounds such as N-vinylpyrrole, N-vinylcarbazole, N-vinylindole, N-vinylpyrolidone, etc.; vinylnaphthalenes; and the like.

And examples of the above monomer having a bifunctional or polyfunctional vinyl polymer for nonlinearization include aromatic divinyl compounds such as, e.g., divinylbenzene, divinylhapthalene, and derivatives of these compounds, etc.; double bond-having carboxylic acid esters such as ethylene glycol diacrylate, ethylene glycol dimethacrylate, trimethylolpropane triacylate, etc.; and the like.

Examples of the nonlinear amorphous vinyl-type polymer formed by the polymerization of the above monomers include styrene-n-butyl acrylate-divinylbenzene copolymer, styrene-n-butyl acrylate-methyl methacrylate-divinylbenzene copolymer, styrene-n-butyl acrylate-ethylene glycol dimethacrylate copolymer, and the like.

The foregoing nonlinear polyester can be obtained by the condensation polymerization reaction of a dihydric carboxylic acid monomer and a dihydric alcohol monomer with a trihydric or polyhydric carboxylic acid monomer and/or a trihydric or polyhydric alcohol monmer for nonlinearization.

Examples of the dihydric carboxylic acid monomer include aromatic carboxylic acids such as, e.g., terephthalic acid, isophthalic acid, naphthalenedicarboxylic acid, etc.; aromatic oxycarboxylic acids such as p-(2-hydroxyethoxy)-benzoic acid; aliphatic polycarboxylic acids such as succinic acid, fumaric acid, adipic acid, maleic acid, sebacic acid, decamethylenedicarboxylic acid, mesaconic acid, citraconic acid, itaconic acid, glutaconic acid, malonic acid, etc.; alicyclic polycarboxylic acids such as 1,4-cyclohexanedicarboxylic acid, 1,3-cyclohexanedicarboxylic acid, hexahydrophthalic acid, tetrahydrophthalic acid, etc.; acid anhydrides of these acids; dimers of lower alkyl esters with linolenic acid; and other dihydric organic acid monomers.

Examples of the foregoing dihydric alcohol monomer include diols such as, e.g., ethylene glycol, diethylene glycol, triethylene glycol, 1,2-propylene-glycol, 1,3-propylene-glycol, 1,4-butanediol, neopentyl glycol, 1,4-butenediol, etc.; 1,4-bis(hydroymethyl)-cyclohexane; etherified bisphenols such as bisphenol A, hydrogenated bisphenol A, polyoxyethylenated bisphenol A, polyoxypropylenated bisphenol A, etc.; and other dihydric alcohol monomers.

Examples of the trihydric or polyhydric alcohol monomer for nonlinearization include, e.g., sorbitol, 1,2,3,6-hexanetetrol, 1,4-sorbitane, pentaerythritol, dipentaerythritol, tripentaerythritol, sugar, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and the like. Examples of the trihydric or polyhydric carboxylic acid monomer include, e.g., 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxylpropane, tetra(methylenecarboxy)methane, 1,2,7,8-octanetetracarboxylic acid, empoltrimeric acids, and acid anhydrides or lower alkyl esters of these acids.

The above trihydric or polyhydric monomer is desirable to be used in a quantity ratio of from 0.1 to 80 mole % to the alcohol or acid constituent as the structural unit of the nonlinear polyester.

The foreging Constituent (B) is incompatible with the foregoing Constituent (A) and is a low-melting polymer having a melting poing of from 50° to 130° C., and preferably from 50° to 120° C. If the low-melting polymer is compatible with Constituent (A), the toner's glass transition point is lowered, deteriorating the toner's antiblocking property. And if the melting point of the low-melting polymer is extremely low, the toner is deteriorated in the antiblocking property as well as in the antifilming property, while if the melting point is extremely high, the toner is deteriorated in the fixability at a low temperature.

The melting point Tmp in this invention is defined as a value obtained by measuring in the following manner: The melting peak value obtained when 10 mg of a sample is heated at a given temperature-increasing speed (10° C./min.) according to the differential scanning calorimetry (DSC) by using, e.g., a 'DSC-20' (Seiko Electronic Industry Co.) is defined as a melting point Tmp.

The clause that 'Component (B) is incompatible with Constituent (A)' herein implies that, when both polymers are meltenly mixed and then cooled to be solidified, the solid appears opaque, or that both polymers being in the moltenly mixed state show the respective constituent polymers' glass transition points.

Such the low-melting polymer is desirable to have a number average molecular weight Mn of from 1,000 to 20,000 and a weight average molecular weight Mw of from 2,000 to 100,000. By using such the suitable molecular weight range-having low-melting polymer, an even more excellent antioffset property-having toner can be obtained, and, in the manufacturing process of the toner, the pulverizability of the toner is improved, whereby the toner's productivity can be raised.

Values of the foregoing weight average molecular weight Mw and number average molecular weight Mn can be found by various methods. The values, although they differ slightly according to the method used, are to be defined in this invention as ones that are obtained in the following measuring method:

According to the gel permeation chromatography (GPC), the weight average molecular weight Mw and number average molecular weight Mn are measured under the following condition: A solvent (tetrahydrofuran) is flowed at a flow rate of 1.2 ml per minute at 40° C., and 3 mg of a tetrahydrofuran solution of a sample in a concentration of 0.2 g/20 ml, as the weight of the sample, are poured into the column, and a measurement is carried out. In measuring the molecular weight of a sample, a measuring condition is selected so that the molecular weight of the sample falls under the range where the logarithm and count number of the molecular weight of a calibration curve prepared from several monodisperse polystyrene reference samples form a straight line.

The reliability of the measured results can be confirmed by the fact that the NBS 706 polystyrene reference sample, when measured under the above measuring condition, shows a weight average molecular weight Mw of $28.8\times10^4$ and a number average molecular weight Mn or $13.7\times10^4$.

The column to be used in GPC may be any column as long as it satisfies the foregoing condition. To be concrete, for example, TSK-GEL, GMH (manufactured by Toyo Soda Mfg. Co.), etc. may be used.

The solvent and measuring temperature are not restricted by the described conditions, and may be changed otherwise properly.

The low-melting polymer content of the toner is preferably from 1 to 50% by weight, and particularly preferably from 5 to 40% by weight. By using such the suitable content range-having low-melting polymer, an even more excellent characteristic can be obtained in the toner. On the other hand, if the low-melting polymer content of the toner is extremely small, the toner's fixability at a low temperature can be deteriorated, whereas if it is extremely large, the toner's triboelectrification property, antioffset property and durability can be deteriorated.

As such the low-melting polymer, crystalline polymers can be used. The crystalline polymer is a polymer at least part of which has a crystalline structure, and includes those homopolymers or copolymers whose at least one constituent is crystallilne, i.e., partially crystallized, showing a sharply clear melting point, and which, when in the solid state at a temperature lower than the melting point, show white turbidity in the crystallline portion thereof.

Example of the crystalline polymer include at-least-partially-crystalline-structure-having crystalline polyesters, crystalline polyethers, crystalline polyamides, crystalline polyurethanes, crystalline polyacrylates, crystalline polymethacrylates, crystalline polyaldehydes, crystalline polyacids, crystalline polylactones, crystalline polyoxazoles, crystalline polyepihalohydrins, crystalline polysulfones, and the like. Of these, the crystalline polyesters are particularly preferred.

Examples of the crystalline polyester include, e.g., polyethylene sebacate, polyethylene adipate, polyethylene suberate, polyethylene succinate, polyethylene-p-(carbophenoxy) undecaate, polyethylene-p-(carbophenoxy) butyrate, polyethylene-p-phenylene diacetate, polyhexamethylene carbonate, polyhexamethylene-p-(carbophenoxy) undecaate, polyhexamethylene oxalate, polyhexamethylene sebacate, polyhexamethylene decanedioate, polyoctamethylene dodecanedioate, polynonamethylene azelate, polynonamethylene terephthalate, polydecamethylene adipate, polydecamethylene azerate, plydecamethylene oxalate, polydecamethylene sebacate, polydecamethylene succinate, polydecamethylene dodecanedioate, polydecamethylene octadecanedioate, polytetramethylene sebacate, polytetramethylene-p-phenylene diacetate, polytrimethylene dodecanedioate, polytrimethylene octadecanedioate, polytrimethylene oxalate, poly-p-xylene adipate, poly-p-xylene sebacate, poly-4,4'-isopropylidenediphenylene adipate, poly-4,4'-isopropylidenephenylene malonate, polyhexamethylenedecamethylene sebacate, polydecamethylene sebacate-terephthalate, polydecamethylene-2-methyl-1,3-propanediol dodecanedioate, and other equivalents.

The above crystalline polyester can be obtained by the condensation polymerization reaction of an alcohol monomer with a carboxylic acid monomer. Examples of the alcohol monomer include, e.g., ethylene glycol, diethylene glycol, 1,3-propylene-glycol, trimethylene glycol, tetramethylene glycol, pentamethylene glycol, hexamethylene glycol, octamethylene glycol, nonamethylene glycol, decamethylene glycol, 4,4'-isopropylidene-biphenol, p-xylene-glycol, neopentyl glycol, cyclohexanedimethanol, polyoxyethylenated bisphenol A, polyoxypropylenated bisphenol A, and the like.

Examples of the carboxylic acid monomer include, e.g., malonic acid, succinic acid, glutaric acid, adipic acid, pimelic acid, suberic acid, glutaconic acid, azelaic acid, sebacic acid, nonanedicarboxylic acid, decanedicarboxylic acid, undecanedicarboxylic acid, dodecanedicarboxylic acid, fumaric acid, mesaconic acid, citraconic acid, itaconic acid, isophthalic acid, terephthalic acid, cyclohexanedicarboxylic acid, anhydrides of these acids, lower alkyl esters of these acids, and the like.

The foregoing Constituent (C) is a copolymer formed by the chemical combination of a segment polymer which is at least compatible with the foregoing Constituent (A) and a segment polymer which is at least compatible with the foregoing Constituent (B).

The term 'compatible' herein implies that, when both polymers are moltenly mixed and then cooled to be in the solid state, the solid appears transparent, or that both polymers, in the moltenly mixed state, show a different glass transition point.

The proportion of the copolymer as Constituent (C) to the toner is preferably from 1 to 50% by weight, and particularly preferably from 3 to 40% by weight. If this proportion is extremely small, the dispersibility of a coloring agent as Constituent (D) can be deteriorated, while if it is extremely large, the durability of the toner can be deteriorated.

The segment polymer which is compatible with Constituent (A) is desirable to be an amorphous segment polymer having a glass transition point Tg of from 50° to 80° C., and the segment polymer which is compatible with Constituent (B) is desirable to be a crystalline segment polymer having a melting point Tmp of from 50° to 130° C. The copolymer of these polymers is desirable to be a graft copolymer or a block copolymer. In the copolymer it is desirable that the segment polymer which is compatible with Constituent (A) and the segment polymer which is compatible with Constituent (B) be combined firmly by a covalent bond.

The segment polymer which is compatible with Constituent (A) is desirable to be one selected from among these nonlinear polymers as Constituent (A), and particularly it is desirable that both be the same. And the segment polymer which is compatible with Constituent (B) is desirable to be one that is selected from among those low-melting polymers as Constituent (B), and particularly it is desirable that both be the same.

As an example of concrete means to chemically combine the respective segment polymers for the formation of a copolymer as Constituent (C), the copolymer can be obtained by combining both the segment polymers by, e.g., the direct head-tail linkage of their terminal functional groups in the coupling reaction therebetween.

In another example, the respective terminal functional groups of both polymers may be bound by the use of an at least bifunctional coupling agent. To be concrete, the copolymer can be obtained by such a linkage as, for example, the urethane linkage formed by the reaction between a polymer whose terminal group is a hydroxyl group and a diisocyanate; the linkage formed by the rection between a polymer whose terminal group is a hydroxyl group and a dicarboxylic acid; the ester linkage formed by the reaction between a polymer whose terminal group is a carboxyl group and a glycol; the linkage formed by the reaction between a polymer whose terminal group is a hydroxyl group and phosgene or dichlorodimethylsilane; or the like.

Examples of such the coupling agent include isocyanates such as hexamethylene diisocyanate, diphenylmethane diisocyanate, tolylene diisocyanate, tolidine diisocyanate, napthylene diisocyanate, isophorone diisocyanate, xylilene diisocyanate, etc.; amines such as ethylenediamine, hexamethylenediamine, phenylenediamine, etc.; carboxylic acids such as oxalic acid, succinic acid, adipic acid, sebacic acid, terephthalic acid, isophthalic acid, etc.; alcohols such as ethylene glycol, propylene glycol, butanediol, pentanediol, hexanediol, cyclohexanedimethanol, p-xylilene-glycol, etc.; acid chlorides such as terephthalic acid chloride, isophthalic acid chloride, adipic acid chloride, sebacic acid chloride, etc.; and other coupling agents such as diisothiocyanates, bisketenes, biscarbodiimides, and the like.

The using proportion of these coupling agents is preferably from 1 to 10% by weight, and particularly preferably from 2 to 7% by weight to the total weight of the segment polymer.

Other methods for obtaining the foregoing copolymer include, for example, the following methods: A segment polymer compatible with Constituent (A) is first sythesized in usual manner, and then to this is added a monomer necessary to form a segment polymer compatible with Constituent (B) to thereby combine both of them so as to have the segment polymer compatible with Constituent (B) extend from the terminal of the segment polymer compatible with Constituent (A), whereby a copolymer can be obtained. Alternatively, the copolymer may also be obtained in the manner that the segment polymer compatible with Constituent (B) is first synthesized in usual manner, and then to this is added a monomer necessary to form the segment polymer compatible with Constituent (A) to thereby combine both so as to have the segment polymer compatible with Constituent (A) extend from the terminal of the segment polymer compatible with Constituent (B).

In the formation of the copolymer as Constituent (C), if necessary, an additional different segment polymer may also be used in addition to the segment polymer compatible with Constituent (A) and the segment polymer compatible with Constituent (B).

The toner of this invention may also contain different other resins in addition to the above Constituents (A), (B) and (C). Examples of the additional different resin include, e.g., styrene-acryl-type copolymers, polyesters, polyamides, polyurethanes, epoxy resins, and the like.

Examples of the coloring agent as Constituent (D) include, e.g., carbon black, Nigrosine dye (C.I. No50415B), Aniline Blue (C.I. No.50405), Calco Oil Blue (C.I. No. azoic Blue 3), Chrome Yellow (C.I. No.14090), Ultramarine Blue (C.I. No77103), DuPont Oil Red (C.I. No.26105), Quinoline Yellow (C.I. No.47005), Methylene Blue Chloride (C.I. No.52015), Phthalocyanine Blue (C.I. No.74160), Malachite Green Oxalate (C.I. No.42000), Lumpblack (C.I. No.77266), Rosebengal (C.I. No.45435), mixtures of these dyes or pigments, and others.

In addition, various other organic or inorganic coloring dyes or coloring pigments may also be used. Particularly, organic coloring pigments vivid, clear in color, having a high resistance to light and a high crypticity, are suitable. To be concrete, for example, the following coloring agents may be used. The following exmplified materials each is indicated by the C.I. name and number described in the Color Index, 3rd ed., 1971 and its supplement 1975, along with an example of corresponding trade names:

C.I. Pigment Red 5
(Permanent Carmine FB, produced by Hoecht Japan)
C.I. Pigment Red 48:1
(Sumikaprint Red C, produced by Sumitomo Chemical Co.)
C.I. Pigment Red 53:1
(Chromophthal Magenta G, produced by Ciba Geigy)
C.I. Pigment Red 57:1
(Sumikaprint Carmine 6BC, produced by Sumitomo Chemical Co.)
C.I. Pigment Red 123
(Kayaset Red E-B, produced by Nippon Kayaku K.K.)
C.I. Pigment Red 139
(Kayaset Red E-GR, produced by Nippon Kayaku K.K.)

C.I. Pigment Red 144
(Chromophthal Red BRN, produced by Ciba Geigy)
C.I. Pigment Red 149
(PV Fast Red B, produced by Hoecht Japan)
C.I. Pigment Red 166
(Chromophthal Scarlet R, produced by Ciba Geigy)
C.I. Pigment Red 177
(Chromophthal Red $A^3B$, produced by Ciba Geigy)
C.I. Pigment Red 178
(Kayaset Red E-GG, produced by Nippon Kayaku K.K.)
C.I. Pigment Red 222
(Chromophthal Red Magenta G, produced by Ciba Geigy)
C.I. Pigment Orange 31
(Chromophthal Orange 4R, produced by Ciba Geigy)
C.I. Pigment Orange 43
(Hostaperm Orange GR, produced by Hoecht)
C.I. Pigment Yellow 17
(Fast Yellow GBFN, produced by Suimitomo Chemical Co.)
C.I. Pigment Yellow 14
(Benzidine Yellow OT, produced by DuPont)
C.I. Pigment Yellow 138
(Pariotol Yellow L0960HD, produced by BASF)
C.I. Pigment Yellow 93
(Chromophthal Yellow 3G, produced by Ciba Geigy)
C.I. Pigment Yellow 94
(Chromophthal Yellow 66, produced by Ciba Geigy)
C.I. Pigment Green 7
(Chromophthal Green GF, produced by Ciba Geigy)
C.I. Pigment Green 36
(Cyanine Green S537-2Y, produced by Dainichi Seika)
C.I. Pigment Blue 15:3
(Cyanine Blue A330, produced by Sanyo Shikiso)
C.I. Pigment Blue 60
(Chromophthal Blue A3R, produced by Ciba Geigy)
C.I. Pigment Violet 23
(Sumikaprint Fast Violet RLN, produced by Sumitomo
Chemical Co.)

If necessary, inorganic pigments such as red oxide, titanium oxide, carbon black, etc., may also be used along with the above materials.

As the coloring dye, for example, azo dyes, anthraquinone dyes, indigo dyes, quinoneimine dyes, phthalocyanine dyes, etc. may be used.

These coloring agents may be used either alone or in combination of two or more of them. The proportion of the coloring agent to the toner is desirable to be 1–20 parts by weight to 100 parts by weight of the toner. Where the toner is to be a magnetic toner, coloring capability-having magnetic materials can be used as the coloring agent.

The essential constituents of the toner of this invention have been described above, but the toner of this invention may, if necessary, contain other additives. Such additives include, for example, magnetic materials, antioffset agents, fixability improving agents, fluidity improving agents, abrasives, charge control agents, and the like. These additives may be contained either in the mixedly dispersed state in the polymer or in the state of adhering to or eating into the polymer grains' surface.

Examples of the foregoing magnetic material include ferrite, magnetite, ferromagnetic metals such as iron, cobalt, nickel, etc.; alloys of these metals; compounds containing these elememts; those alloys which do not contain any ferromagnetic elements but, when subjected to a proper heat treatment, show ferromagneticity; those manganese-and-copper-containing alloys called 'whistler alloy' such as, for example, manganese-copper-aluminum, manganese-copper-tin, and the like; and chromium dioxide and others. Any of these magnetic materials is desirable to be in the fine powdery form having an average grains size of from 0.1 to 1 μm and to be contained in the uniformly dispersed state in the polymer. Where the toner is to be a magnetic toner, the proportion of the magnetic material to the toner is preferably from 20–70 parts by weight to 100 parts by weight of the toner, and particularly preferably 25 to 50 parts by weight.

As the foregoing antioffset agent or fixability improving agent, for example, a wax having a melting point of from 50° to 150° C. may be suitably used. Examples of such the agent include liquid or solid paraffin, polyolefins such as polyethylene, polyrpopylene, etc., fatty acid metallic salts, fatty acid esters, partially saponified fatty acid esters, higher fatty acids, higher alcohols, silicone varnish, amide-type waxes, aliphatic fluorocarbons and their modified compounds, and the like. The proportion of the agent to the toner is preferably from 0.1 to 30% by weight, and particularly preferably from 0.2 to 10% by weight. The use of such the antioffset or fixability improving agent as a constituent of the toner makes the toner's property even more excellent. For example, the heat roller fixing process usually uses a cleaning roller closely juxtaposed to the heat roller to thereby remove the toner stain from the surface of the heat roller, but where the toner contains the above antioffset or fixability improving agent, the toner material is effectively prevented from being transferred to adhere onto the heat roller, so thaat the use of the agent is advantageous in respect of lengthening the usable life span of both cleaning and heat rollers.

As the foregoing fluidity improving agent or abrasive, for example, inorganic fine particulate materials or other equivalents may be used, and their primary particle size is preferably from 5 mμ to 2 mμ, and more preferably from 5 mμ to 500 mμ. And their specific surface area according to the BET method is desirable to be from 20 to 500 $m^2/g$. The proportion of such the fine particulate material to the toner is preferably from 0.01 to 5% by weight, and particularly preferably from 0.1 to 2.0% weight. These fine particles are desirable to be contained in the toner in the state of adhering to or eating into the toner grains' surface. Useful examples of the fine particulate material include silica, alumina, titanium oxide, barium titanate, magnesium titanate, calcium titanate, strontium titanate, zinc oxide, silica sant, clay, mica, wollastonite, diatom earth, chromium oxide, cerium oxide, red oxide, antimony trioxide, magnesium oxide, zirconium oxide, barium sulfate, barium carbonate, calcium carbonate, silicon carbide, silicon nitride, and the like. Out of these materials, the silic fine particulate material is particularly useful.

The silica fine particulate material is one having the following structural formula, which may be one prepared by either the wet process or the dry process.

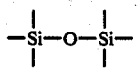

The silica may be in the form of any of anhydrous silica dioxide, aluminum silicate, sodium silicate, potassium silicate, magnesium silicate, zinc silicate, or the like, and is particularly preferably one containing more than 85% by weight $SiO_2$.

There are a variety of commercially available silica products, but among them those having a hydrophobic group on the surface thereof are suitable usable. Such useful products are, for example, 'Aerosil R-972,' 'Aerosil R-974,' 'Aerosil R-805,' 'Aerosil R-812,' (produced by Nippon Aerosil), and 'Talanox 500' (produced by Talco), and the like. Besides, those silica fine particles surface-treated by a silane-coupling agent, titanium-coupling agent, silicone oil, or a silicone oil having amine on its side chain, or the like, may be effectively used.

As the foregoing charge control agent any known materials may be used without being particularly restricted. Negatively chargeable ones of these materials includes those 2:1-type metal-containing azo dyes as disclosed in, e.g., Japanese Patent Publication Open to Public Inspection (hereinafter referred to as Japanese Patent O.P.I. Publication) Nos. 141452/1982, 7645/83, 111049/1983, 185653/1983, 167033/1982, 6397/1969, etc.; those metallic complex salts of aromatic oxycarboxylic acids and aromatic dicarboxylic acids as disclosed in Japanese Patent O.P.I. Publication Nos. 104940/1982, 111541/1982, 124357/1982, 127726/1983, etc.; those sulfonylamine derivatives of copper-phthalocyanine dyes or sulfonamido derivative dyes of copper-phthalocyanines, and sulfonamides, sulfonic acid or sulfonic acid salt derivative dyes of copper-phthalocyanines as disclosed in Japanese Patent O.P.I. Publication No. 45931/1977; and the like.

Positively chargeable ones of these materials as the charge control agent include those quaternary ammonium compounds as disclosed in Japanese Patent O.P.I. Publication Nos. 51951/1974, 10141/1977, etc.; those alkylpyridinium compounds as disclosed in Japanese Patent O.P.I. Publication Nos. 11461/1981 and 158932/1979, and U.S Pat. No. 4,254,205; nigrosine-type dyes such as Nigrosine SO, Nigrosine EX, etc.; those addition condensates as disclosed in Japanese Patent Examined Publication No. 80320/1974; and the like.

The proportion of such the charge control agent to the toner is preferably from 0.1 to 10% by weight, and particularly preferably from 0.3 to 5% by weight.

The softening point Tsp of the toner of this invention is preferably from 90° to 150° C., and particularly preferably from 100° to 140° C. If the softening point Tsp is extremely low, the antioffset property of the toner can be deteriorated, while if it is extremely high, the fixability at a low temperature can be deteriorated.

The terms 'softening point Tsp' herein means a temperature at the time of h/2, the h being the height of the S-shaped curve, the plunger's descent amount-temperature curve (softening-fluidity curve), obtained when 1.0 $cm^3$ quantity of a sample (a weight expressed by absolute specific gravity $\times 1$ $cm^3$) is measured and recorded by use of a flow tester CFT-500 (manufactured by Shimazu Seisakusho, Ltd.) under the conditions of a load of 20 $kg/cm^2$, a nozzle diameter of 1 mm, preheating at 50° C. for 10 minutes, and a temperature increasing rate of 6° C./min.

The toner of this invention may be produced by, e.g, the following method: To a specific polymer constituent as mentioned previously or to one formed by adding other resins thereto are added a coloring agent and, if necessary, further other additives, and these are then molten and kneaded by, e.g., an extruder. The kneaded product is cooled and then pulverized by means of a jet mill or the like and then classified, whereby a desired grain size-having powdery toner can be obtained. Further, if other odditives are additionally added and mixed into the toner, a toner improved on its characteristics may be obtained.

Alternatively, if the toner moltenly kneaded by an extruder, with the molten state being kept intact, is sprayed by a spray dryer or dispersed into a liquid, any desired grain size-having toner can be obtained.

The toner of this invention is for use in heat-roller fixing, and the image formation with this toner is carried out in, e.g., the following manner: That is, in the electrophotographic process, and electrostatic latent image formed on a latent image carrer photoreceptor is developed by a developer comprising the toner of this invention, and the obtained toner image is then transferred, e.g., electrostatically, onto a copying sheet made of paper or the like. The transferred toner image is then fixed by the heat-roller fixing process, whereby a visible image is formed. The heat-roller fixing device to be used in the heat-roller fixing process is comprised generally of a heat roller, a contact roller which is closely juxtaposed to the heat roller, and a heat source. And the fixing device, with the heat roller being heated by the heat souce so as to be kept in a specified temperature range, allows a support bearing the transferred toner image to pass between the pair of rollers to come into direct contact with the heat roller, whereby the toner image is thermally fixed to the support.

The toner of this invention displays a remarkably excellent effect compared to conventional toners particularly in the case where a fixing operation is made at such a high speed that the time of contact of the toner image on a support with the heat roller is within 1 second, preferably not more than 0.5 second.

Examples

Examples of the present invention and compartive examples will be illustrated in detail below, but the invention is not limited to and by the following examples.

The respective compositions of the polymers used in the following examples of this invention and comparative examples are as given in Table 1, Table 2 and Table 3 which will be hereinafter set forth. And in the examples and comparative examples, the respective polymers were used in the combinations and proportions given in Table 4.

EXAMPLES 1 TO 6 AND COMPARATIVE EXAMPLES 1 TO 5

In the examples and comparative examples, the respective toners therefor were prepared in the following manner:

One hundred parts by weight of each total amount of the polymers given for each sample in Table 4, each coloring agent, 3 parts by weight of polypropylene 'Viscol 660P' (produced by Sanyo Chemical Ind. Co.), 2 parts by weight of 'Wax-E' (produced by Hoecht) and 2 parts by weight of a charge control agent 'Bontron E-81' (produced by Orient Chemical Co.) were mixed and kneaded by means of a heat roll, then cooled and then pulverized, and further finely pulverized by an ultrasonic jet mill, and subsequently classified by a wind classifier, whereby a colored particulate material was obtained.

To 100 parts by weight of the obtained colored particulate material was added 0.8 part by weight of a hydrophobic silica powder 'Aerosil R-972' (produced by Nippon Aerosil), and these were mixed by a V-type mixer, and thus, in this manner, toners having a volume average size of 11.0 μm were obtained.

These toners obtained in Examples 1 to 6 and Comparative Examples 1 to 5 were regarded as Toner-1 through Toner-6 and Compatative Toner-1 through Comparative Toner-5, respectively.

Subsequently, 3 parts by weight of each of Toners-1 to -6 and Comparative Toners-1 to -5 were mixed with 97 parts by weight of a styrene-methyl methacrylate copolymer resin-coated carrier having an average grain size of 110 μm, whereby 11 different developers were prepared. These developers each was used to perform a practical copying test in an electrophotographic copying apparatus 'U-Bix 5000' (manufactured by Konishiroku Photo Industry Co.) to form an electrostatic latent image and then develope the image, and the thus obtained toner image was transferred onto a copying sheet of paper, and the transferred toner image was then fixed by the heat-roller fixing device to thereby obtain a copy image, and in the test, the minimum fixing temperature (fixable minimum temperature of the heat roller) and offset occurring temperature (offset phenomenon occurring minimum temperature) were measured, and at the same time the fixable temperature range was found.

MINIMUM FIXING TEMPERATURE

In the above-mentioned copying apparatus, an unfixed toner image by the sample toner was formed and then transferred onto a 64 g/m$^2$ copying paper, and the formed toner image was fixed by a heat-roller fixing device comprised of a 50ϕ heat roller whose surface layer is formed with a Teflon coat (polytetrafluoroethylene, produced by DuPont) and a pressure roller whose surface layer is formed with a silicone rubber 'KE-1300RTV' (produced by Shin'etsu Chemical Industry Co.) under the conditions of a heat roller's linear speed of 200 mm/sec., a linear pressure of 0.8 kg/cm, and a nip width of 8.0 mm; this fixing procedure was repeated at each staged temperature increase by 5° C. within the range of from 80° to 230° C., and these formed fixed images each was then subjected to a rubbing test using the same paper as that of the copy image by means of a fastness tester, and the minimum of temperatures set for the fixed image showing its adequate resistance to rubbing was regarded as the minimum fixing temperature. The heat-roller fixing device used herein is one having no silicone oil supply mechanism.

OFFSET OCCURRING TEMPERATURE

Measurement of the offset occurring temperature is similar to that of the above minimum fixing temperature: After the formation of an unfixed image in the foregoing copying apparatus, the toner image was transferred onto a copying paper and then fixed by the above heat roller fixing device. After that, a plain white paper sheet, under the same condition, was sent through the heat-roller fixing device to observe whether the paper is stained or not by the toner. This precedure was repeated, gradually increasing the temperature of the heat roller of the heat-roller fixing device, and the minimum of temperatures set when the toner stain appeared was regarded as the offset occurring temperature.

FIXABLE TEMPERATURE RANGE

The difference between the offset occurring temperature and the minimum fixing temperature measured in the above manner was regarded as the fixable temperature range.

The results obtained in above are shown in Table 5.

Further, the antiblocking property, color tone, and quqntity of charge (Q/M) of the toner were measured as follows:

ANTIBLOCKING PROPERTY

Each toner was allowed to stand for two hours under the environmental condition of a temperature of 50° C. with a relative humidity of 43% to judge whether agglomerated lumps are produced or not in the toner, and the toner, where no such lumps were found, is indicated with 'O', where such lumps were found to some extent, is indicated with 'Δ', and, where such lumps were found remarkably, is indicated with 'X' in Table 5.

COLOR TONE

It was judged by the eye.

QUANTITY OF CHARGE (Q/M)

This was measured by the blow-off method of the prior art, and the quantity of the triboelectrified charge per gram of the toner was regarded as the quantity of charge (Q/M).

The results obtained in above are also given in Table 5.

In addition, the image copies obtained in the practical copying tests with use of the foregoing copying apparatus were evaluated with respect to fogging and clearness as follows:

FOG

A SAKURA Densitometer (manufactured by Konishiroku Photo Industry Co.) was used to measure and evaluate the relative density of each developed image corresponding to the original's white background density being 0.0, provided the reflection density of the white background was regarded as 0.0. The results of the evaluation are given in Table 5 by indicating a mark of 'O' for one having a relative density of less than 0.01, a mark of 'Δ' for one having a relative density of not less than 0.01 and less than 0.03, and a mark of 'X' for one having a relative density of not less than 0.03.

CLEARNESS

A line drawing chart was used as an original, and the reproducibility of each formed image from the original was enlarged to be judged visually. The results of the evaluation in the judgement are given in Table 5 by indicating a mark of 'O' for one showing good reproduction, a mark of 'Δ' for one considered not good but practically usable, and a mark of 'X' for one so poor in the reproduction that it is unacceptable for practical use.

All the above results are as given in Table 5.

Further, practical copying tests were repeated in succession in the foregoing copying apparatus to thereby examine the durability of each toner as follows:

The image forming process was repeated 30,000 times in the copying apparatus, and the 30,000th copy image was measured and evaluated with respect to its fog and clearness in similar manner to the above. The obtained results are also given in Table 5.

TABLE 1

| | Polymer A (for the invention) | Glass transition point Tg (°C.) | Softening point Tsp (°C.) |
|---|---|---|---|
| A-1 | Styrene/n-butyl-acrylate/divinyl-benzene copolymer (proportion by wt = 83.5:15:1.5) | 66 | 134 |
| A-2 | Styrene/methyl methacrylate/n-butylacrylate/divinylbenzene copolymer (proportion by wt = 68:10:20:2) | 58 | 126 |
| A-3 | Polyoxypropylenebisphenol A/terephthalic acid/trimellitic acid condensation polymerization product (molar ratio = 50:20:30) | 65 | 128 |

TABLE 2

| | | Polymer B | Melting point Tmp (°C.) | Wt average molecular wt Mw | Number average molecular wt Mn |
|---|---|---|---|---|---|
| For invention | B-1 | Polyhexamethylene sebacate | 65 | 14,000 | 4,600 |
| | B-2 | Polydecamethylene adipate | 78 | 12,000 | 3,800 |
| | B-3 | polyethylene succinate | 95 | 8,900 | 3,100 |
| | B-4 | Polyethylene sebacate | 72 | 10,400 | 3,300 |
| | B-5 | Polytrimethylene sebacate | 53 | 6,300 | 2,000 |
| | B-6 | Polydecamethylene terephthalate | 129 | 8,700 | 2,400 |
| Comparative | B-7 | Polyethylene adipate | 47 | 7,600 | 2,900 |
| | B-8 | Polyhexamethylene terephthalate | 160 | 9,100 | 3,200 |

TABLE 3

| | Polymer a compatible with Polymer A | | Polymer b compatible with Polymer B | | Coupling agent for chemical combination of Polymer a with Polymer b | |
|---|---|---|---|---|---|---|
| Copolymer | Type | Proportion (parts by wt) | Type | Proportion (parts by wt) | Type | Proportion (parts by wt) |
| C-1 | a-1 | 80 | B-1 | 20 | Hexamethylene diisocyanate | 4 |
| C-2 | a-2 | 70 | B-3 | 30 | Toluylene diisocyanate | 4 |
| C-3 | a-2 | 75 | B-2 | 25 | Hexamethylene diisocyanate | 4 |
| C-4 | a-1 | 75 | B-4 | 25 | Toluylene diisocyanate | 4 |
| C-5 | a-1 | 80 | B-5 | 20 | Hexamethylene diisocyanate | 4 |
| C-6 | a-1 | 80 | B-6 | 20 | Hexamethylene diisocyanate | 4 |
| C-7 | a-1 | 80 | B-7 | 20 | Hexamethylene diisocyanate | 4 |
| C-8 | a-1 | 80 | B-8 | 20 | Hexamethylene diisocyanate | 4 |

Note:

a-1: Polypropylene isophthalate (glass transition point Tg = 54.5° C., weight average molecular weight Mw = 13,400, Number average molecular weight Mn = 4,500)

a-2: Polyoxypropylene-bisphenol A/fumarate/terephthalate (molar ratio = 2:1:1) (glass transition point Tg = 67° C., weight average molecular weight Mw = 13,300, number average molecular weight Mn = 4,600)

B-1 through B-8 are the same as the Polymers B in Table 2.

TABLE 4

| | Polymer A | | Polymer B | | Polymer C | | Coloring agent | |
|---|---|---|---|---|---|---|---|---|
| | Type | Ratio | Type | Ratio | Type | Ratio | Type | Ratio |
| Toner 1 | A-1 | 70 | B-1 | 20 | C-1 | 10 | Carbon black 'Mogal L' (Cabot) | 10 |
| Toner 2 | A-2 | 65 | B-2 | 25 | C-3 | 10 | 'PV Fast Red B' (Hoecht Japan) | 6 |
| Toner 3 | A-3 | 65 | B-3 | 25 | C-2 | 10 | 'Benzidine Yellow OT' (DuPont) | 4 |
| Toner 4 | A-1 | 70 | B-4 | 25 | C-4 | 5 | 'Cyanine Blue A 330' (Sanyo Shikiso) | 5 |
| Toner 5 | A-3 | 75 | B-5 | 15 | C-5 | 10 | Carbon black 'Mogal L' (Cabot) | 10 |
| Toner 6 | A-3 | 55 | B-6 | 35 | C-6 | 10 | Carbon black 'Mogal L' (Cabot) | 10 |
| Comparative Toner 1 | A-3 | 65 | B-7 | 25 | C-7 | 10 | Carbon black 'Mogal L' (Cabot) | 10 |
| Comparative Toner 2 | A-3 | 65 | B-8 | 25 | C-8 | 10 | Carbon black 'Mogal L' (Cabot) | 10 |
| Comparative Toner 3 | A-3 | 75 | B-3 | 25 | — | — | Carbon black 'Mogal L' (Cabot) | 10 |
| Comparative Toner 4 | — | — | B-1 | 100 | — | — | Carbon black 'Mogal L' (Cabot) | 10 |
| Comparative Toner 5 | A-1 | 100 | — | — | — | — | Carbon black 'Mogal L' (Cabot) | 10 |

Note:

The values shown in the 'Ratio' columns are in parts by weight.

TABLE 5

| Toner | Minimum fixing temp. (°C.) | Offset occurring temp. (°C.) | Fixable temp. range (°C.) | Anti-blocking property | Color tone | Q'ty of charge μC/g | Fog | Clear-ness | 30,000th copy image Fog | 30,000th copy image Clear-ness |
|---|---|---|---|---|---|---|---|---|---|---|
| Toner 1 | 95 | above 230 | above 135 | O | Good | −21 | O | O | O | Δ |
| Toner 2 | 105 | above 230 | above 125 | O | Good | −23 | O | O | O | O |
| Toner 3 | 100 | above 230 | above 130 | O | Good | −22 | O | O | O | O |
| Toner 4 | 95 | above 230 | above 135 | O | Good | −21 | O | O | O | O |
| Toner 5 | 95 | 230 | 135 | O | Good | −19 | O | O | O | Δ |
| Toner 6 | 105 | above 230 | above 125 | O | Good | −23 | O | O | O | O |
| Comparative Toner 1 | 100 | 135 | 85 | X | Good | −10 | X | X | X | X |
| Comparative Toner 2 | 160 | above 230 | above 70 | O | Good | −21 | O | O | O | O |
| Comparative Toner 3 | 110 | above 230 | above 120 | O | Bad | −12 | Δ | Δ | X | X |
| Comparative Toner 4 | 90 | 90 | None | O | Bad | −5 | X | X | X | X |
| Comparative Toner 5 | 160 | above 230 | above 70 | O | Good | −23 | O | O | O | O |

As is understood from the results given in Table 5, any of Toners 1 to 6 is excellent in the fixability at a low temperature, antioffset property, antiblocking property, triboelectrification property, durability and color tone, and is capable of stably forming a clear image with no fog.

In contrast, Comparative Toner 1, since the melting point of its low-melting polymer as Constituent (B) is extremely low, is so poor in the antiblocking property that the resulting copy image is unclear with much fog, and these shortcomings become more conspicuous after making 30,000 image copies, so that the toner is eventually inferior in the durability.

Comparative Toner 2, since the melting point of its low-melting polymer is extremely high to the contrary, is so poor in the fixability at a low temperature that it tends to cause an inadequate-fixation trouble.

Comparative Toner 3, since it contains no copolymer as Constituent (C), shows inadequate dispersion of the coloring agent, so that the obtained copy image is poor in the color tone, and the toner's triboelectrification property is low, resulting in the copy image being unclear with much fog. These shortcomings become more conspicuous after making 30,000 image copies, so that the toner is eventually inferior in the durability.

Comparative Toner 4, since it contains neither any linear polymer as Constituent (A) nor any copolymer As Constituent (C), is poor in the antioffset property and triboelectrification property as well as in the coloring agent's dispersibility, thus resulting in the copy image being nuclear image with much fog.

And Comparative Toner 5, since it contains neither any low-melting polymer as Constituent (C) nor any copolymer as Constituent (C), is so poor in the fixability at a low temperature that it tends to cause an inadequate-fixation trouble.

What is claimed is:

1. An electrostatic image developing toner which comprises a nonlinear polymer, a low-melting polymer which has a melting point of from 50° to 130° C. and which is incompatible with said nonlinear polymer, a copolymer composed of a segment polymer which is at least compatible with the above nonlinear polymer and a segment polymer which is at least compatible with said low-melting polymer and a coloring agent.

2. The electrostatic image developing toner of claim 1, wherein said nonlinear polymer has a glass transition point of from 40° to 80° C.

3. The electrostatic image developing toner of claim 2, wherein said nonlinear polymer has a glass transition point of from 50° to 80° C.

4. The electrostatic image developing toner of claim 3, wherein said nonlinear polymer has a glass transition point of from 55° to 70° C.

5. The electrostatic image developing toner of claim 1, wherein said nonlinear polymer has a weight average molecular weight of not less than 50,000.

6. The electrostatic image developing toner of claim 1, wherein said nonlinear polymer is contained in said toner at a proportion of 50 to 99% by weight with respect to the total weight of said toner.

7. The electrostatic image developing toner of claim 6, wherein said nonlinear polymer is contained in said toner at a proportion of 55 to 95% by weight.

8. The electrostatic image developing toner of claim 1, wherein said nonlinear polymer is an amorphous polymer selected form the group consisting of a vinyl polymer, a polyester, an epoxy resin, a polyamide, a polyurethane and a phenol resin.

9. The electrostatic image developing toner of claim 8, wherein said nonlinear polymer is an amorphous polymer of a vinyl polymer or a polyester.

10. The electrostatic image developing toner of claim 1, wherein said low-melting polymer has a melting point of from 50° to 120° C.

11. The electrostatic image developing toner of claim 1, wherein said low-melting polymer has a number average molecular weight of from 1,000 to 20,000 and a weight average molecular weight of from 2,000 to 100,000.

12. The electrostatic image developing toner of claim 1, wherein said low-melting polymer is contained in said toner at a proportion of 1 to 50% by weight with respect to the total weight of said toner.

13. The electrostatic image developing toner of claim 12, wherein said low-melting polymer is contained in said toner at a proportion of 5 to 40% by weight.

14. The electrostatic image developing toner of claim 1, wherein said low-melting polymer is a polymer at least part of which has a crystalline structure.

15. The electrostatic image developing toner of claim 14, wherein said low-melting polymer is a homopolymer or a copolymer of a polyester, a polyether, a polyamide, a polyurethane, a polyacrylate, a polymethacrylate, a polyaldehyde, a polyacid, a polylactone, a polyoxazole, a polyepihalohydrin and a polysulfone.

16. The electrostatic image developing toner of claim 15, wherein said low-melting polymer is a homopolymer or a copolymer of a polyester.

17. The electrostatic image developing toner of claim 1, wherein said copolymer is contained in said toner at a proportion of 1 to 50% by weight with respect to the total weight of said toner.

18. The electrostatic image developing toner of claim 17, wherein said copolymer is contained in said toner at a proportion of 3 to 40% by weight with respect to the total weight of said toner.

19. The electrostatic image developing toner of claim 1, wherein said segment polymer which is at least compatible with the above nonlinear polymer is an amorphous segment polymer having a glass transition point of from 50° to 80° C., and the segment polymer which is compatible with said low-melting polymer is a crystalline segment polymer having a melting point of from 50° to 130° C.

20. The electrostatic image developing toner of claim 1, wherein said copolymer is a graft copolymer or a block copolymer.

21. The electrostatic image developing toner of claim 1, wherein said segment polymer which is at least compatible with said nonlinear polymer is selected from an amorphous polymer of which monomer component is selected from one used for said nonlinear polymer.

22. The electrostatic image developing toner of claim 21, wherein said segment polymer which is at least compatible with the said low-melting polymer is selected from a crystalline polymer of which monomer component is selected from one used for said low-melting polymer.

23. A method of fixing a toner image formed on a recording sheet in electrophotography comprising a step of bringing said toner image into contact with a heated roller under pressure, said toner comprising a nonlinear polymer, a low-melting polymer which has a melting point of from 50° to 130° C. and which is incompatible with said nonlinear polymer, a copolymer composed of a segment polymer which is at least compatible with the above nonlinear polymer and a segment polymer which is at least compatible with said low-melting polymer and a coloring agent.

24. A method of forming a toner image in electrophotography comprising a step of forming imagewise an electrostatic latent image on a photoconductive element, a step of developing said latent image with a toner, said toner comprising a nonlinear polymer, a low-melting polymer which has a melting point of from 50° to 130° C. and which is incompatible with said nonlinear polymer, a copolymer composed of a segment polymer which is at least compatible with the above nonlinear polymer and a segment polymer which is at least compatible with said low-melting polymer and a coloring agent, a step of transferring said toner image on to a recording sheet and a step of bringing said toner image into contact with a heated roller under pressure for fixture.

* * * * *